US005860188A

United States Patent [19]

Maurer et al.

[11] Patent Number: 5,860,188

[45] Date of Patent: Jan. 19, 1999

[54] CARPET EXTRACTOR

[75] Inventors: Edgar A. Maurer; Darwin S. Crouser, both of Canton; Jeffrey S. Louis, Canal Fulton, all of Ohio

[73] Assignee: The Hoover Company, North Canton, Ohio

[21] Appl. No.: 931,752

[22] Filed: Sep. 16, 1997

Related U.S. Application Data

[60] Provisional application No. 60/002,187 Aug. 11, 1995.

Related U.S. Application Data

[63] Continuation of Ser. No. 677,069, Jul. 9, 1996, abandoned.

[51] Int. Cl.[6] ..... A47L 7/00

[52] U.S. Cl. ..... 15/320; 15/321; 15/331; 15/332; 15/387

[58] Field of Search ..... 15/320, 321, 322, 15/331, 332, 387

[56] References Cited

U.S. PATENT DOCUMENTS

| | | | |
|---|---|---|---|
| 1,495,222 | 5/1924 | Clark . | |
| 2,000,930 | 5/1935 | Nagy . | |
| 2,045,980 | 6/1936 | Nagy . | |
| 2,078,634 | 4/1937 | Karlstrom . | |
| 2,246,036 | 6/1941 | Farrell . | |
| 2,331,692 | 10/1943 | Hunt . | |
| 2,653,546 | 9/1953 | Marlow, Jr. . | |
| 2,731,022 | 1/1956 | Fischer et al. . | |
| 2,777,152 | 1/1957 | Cosentino . | |
| 2,881,466 | 4/1959 | Bramhall . | |
| 2,904,816 | 9/1959 | Skolfield . | |
| 2,904,817 | 9/1959 | Brennen . | |
| 2,915,774 | 5/1959 | Darrow . | |
| 2,930,069 | 3/1960 | Kowalewski . | |
| 2,946,080 | 7/1960 | Burch . | |
| 2,962,748 | 12/1960 | Magarian . | |
| 3,102,292 | 9/1963 | Jepson et al. . | |
| 3,120,016 | 2/1964 | Knapp et al. . | |
| 3,139,034 | 6/1964 | Amirault et al. . | |
| 3,155,112 | 11/1964 | Rosser . | |
| 3,305,887 | 2/1967 | Turner . | |
| 3,688,339 | 9/1972 | Vincent et al. . | |
| 3,974,541 | 8/1976 | Silvis et al. . | |
| 4,167,798 | 9/1979 | Klugl et al. | 15/321 X |
| 4,268,935 | 5/1981 | Bessinger . | |
| 4,458,377 | 7/1984 | Frohbieter . | |
| 4,558,484 | 12/1985 | Groth . | |
| 4,589,161 | 5/1986 | Kochte et al. . | |
| 4,809,397 | 3/1989 | Jacobs et al. | 15/321 X |

(List continued on next page.)

FOREIGN PATENT DOCUMENTS

| | | |
|---|---|---|
| 0202175A1 | 11/1986 | European Pat. Off. . |
| 2328439 | 10/1975 | France . |
| 54-131358 | 12/1979 | Japan . |

OTHER PUBLICATIONS

Regina Steemer Ultra 8.0, owners manual, copyright 1991.

Aerodynamics of Turbines and Compressors, vol. X, 1964, pp. 534, 544, 545.

Turbomachines, copyright 1981, pp. 304, 315, 318.

Blue Lustre, Rinsenvac, model MBU–5 instruction manual.

Chemko models 75A, 75B & 75C (2 pages).

"The Guzzler" Certified Chemical & Equipment Co. product manual, 19 pages, 1974.

*Primary Examiner*—Chris K. Moore

*Attorney, Agent, or Firm*—Renner, Kenner, Greive, Bobak, Taylor & Weber

[57] ABSTRACT

The herein disclosed invention relates to an improved carpet extractor having powered brushes for scrubbing a floor surface and which may be converted to an above the floor mode for upholstery cleaning or the like. A pair of air driven turbines are disclosed, one for driving the floor scrubbing brushes when in the floor cleaning mode and one for driving a cleaning solution supply pump when in the above floor cleaning mode. A unique linkage mechanism is taught whereby only one turbine or the other is energized depending upon the cleaning mode selected by the operator.

32 Claims, 7 Drawing Sheets

U.S. PATENT DOCUMENTS

| | | | |
|---|---|---|---|
| 4,859,144 | 8/1989 | Houston . | |
| 4,893,375 | 1/1990 | Girman et al. | 15/320 X |
| 5,088,149 | 2/1992 | Berg et al. | 15/321 X |
| 5,168,599 | 12/1992 | Williams | 15/387 X |
| 5,184,370 | 2/1993 | Jung | 15/321 |
| 5,293,665 | 3/1994 | Worwag . | |
| 5,345,650 | 9/1994 | Downham et al. | 15/331 |
| 5,416,948 | 5/1995 | Worwag | 15/331 |
| 5,493,752 | 2/1996 | Crouser et al. . | |
| 5,615,448 | 4/1997 | Crouser et al. . | |

CARPET EXTRACTOR

CROSS REFERENCE TO RELATED APPLICATION

This application is a continuation of application Ser. No. 08/677,069, filed Jul. 9, 1996 now abandoned, which claims the benefit of U.S. Provisional Application No. 60/002,187 filed Aug. 11, 1995.

BACKGROUND OF THE INVENTION

The present invention relates to a carpet extractor and more particularly to an upright extractor having powered scrub brushes for cleaning the carpet.

BRIEF DESCRIPTION OF THE INVENTION

In a carpet extractor having powered brushes for scrubbing the surface being cleaned, it is undesirable to power the brushes by electrical means, such as an electric motor, because of the general presence of liquids, such as water, in the vicinity. Therefore, the present invention discloses and teaches an extractor suitable for scrubbing carpeted and/or bare floors without the use of electric powered brushes.

Taught herein is an extractor employing dual air driven turbines, one for driving floor scrubbing brushes when used in the floor cleaning mode and a second for driving a cleaning solution supply pump, when used in the above floor upholstery cleaning mode.

A unique mechanical linkage system is disclosed whereby the brush drive turbine and the pump drive turbine are automatically energized or de-energized depending on the use selected by the operator. When in the floor cleaning mode, the brush drive turbine is energized and the pump drive turbine is de-energized and when in the above floor cleaning mode, the pump drive turbine is energized and the brush drive turbine de-energized. Also disclosed is an override mechanism whereby the operator may manually de-energize the brush drive turbine, when in the floor cleaning mode, for use on spills and/or select an intermediate speed for the powered brushes if desired.

DETAILED DESCRIPTION OF THE INVENTION

Figure 1:
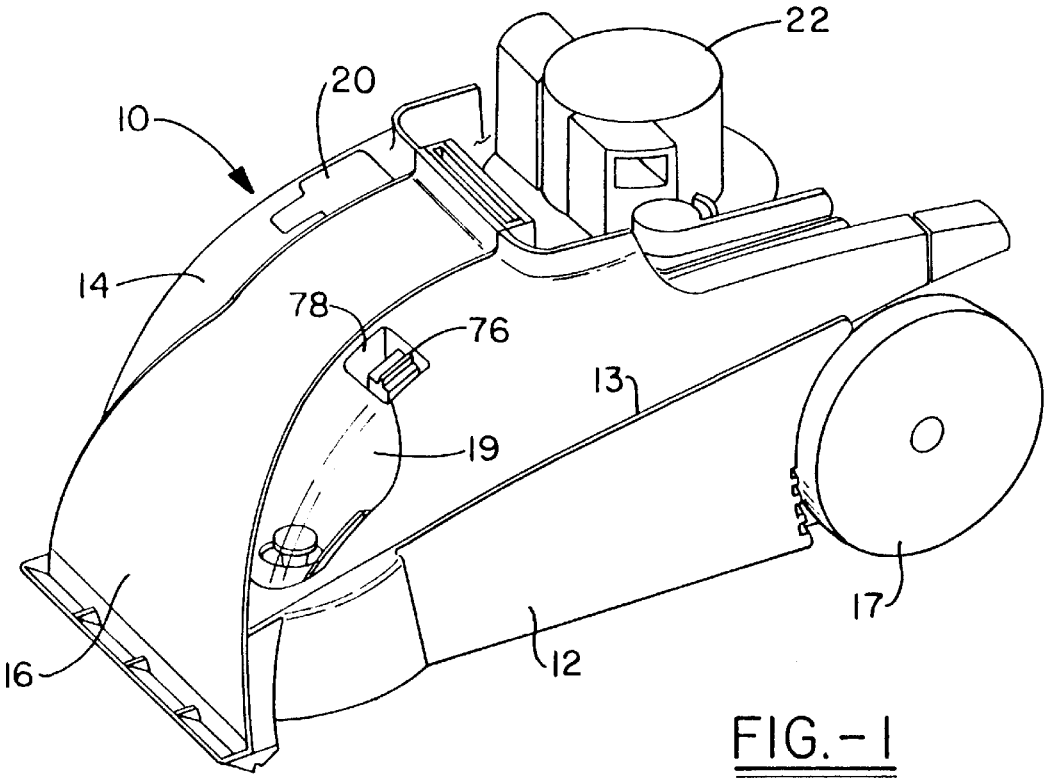
FIG. 1 presents a pictorial view of an upright carpet extractor base module embodying our invention.

Referring to FIG. 1, the present invention relates to a base module 10 for an upright carpet extractor. The upper portion of a typical upright carpet extractor suitable for use in combination with the herein described base module 10 may be found in co-owned U.S. Pat. No. 5,406,673 issued on Apr. 18, 1995, titled "Tank Carry Handle and Securement Latch", the teachings of which are incorporated herein by reference.

Base module 10 comprises a lower housing 12 and an upper housing 14 which generally separate along parting line 13. Suction nozzle 16 having a suction inlet 18 are part of the upper housing 14. The general structural arrangement and assembly of lower housing 12, upper housing 14, and nozzle 16 is similar to that as taught in the above referenced co-owned patent.

Referring now to FIGS. 2, 3, 4, and 5, the lower housing 12 generally comprises a one-piece molded body (similar to that as taught in the above referenced U.S. Patent) having affixed thereto a motor fan assembly 22 for providing a working vacuum for the extractor, and air driven turbine 25 providing motive power for a floor scrubbing brush system 26 contained within base housing brush cavity 24. A suitable brush system is taught in a co-owned and co-pending provisional patent application identified as Hoover Case No. 2442, now Ser. No. 08/678,496, filed simultaneously with the herein application. Brush system 26 is operated by a suitable gear train (or other known means), not shown, contained in transmission housing 27. A suitable air turbine driven gear train is taught in co-owned U.S. Pat. No. 5,443,362 issued on Aug. 22, 1995 and titled "Air Turbine".

A suitable scrubbing brush system is taught in co-pending U.S. Patent Application titled "Carpet Extractor Brush Assembly" and presently identified as Hoover Case No. 2442, Ser. No. 08/678,496, filed simultaneously with the herein application.

Also affixed to lower housing 12 is an air turbine driven fluid pump 30 for providing a pressurized cleaning solution supply for above floor cleaning apparatus. The structure of air turbine driven fluid pump 30 and its general operation and functional use is fully described in co-owned U.S. Pat. No. 5,406,673 referenced above.

Figure 4:
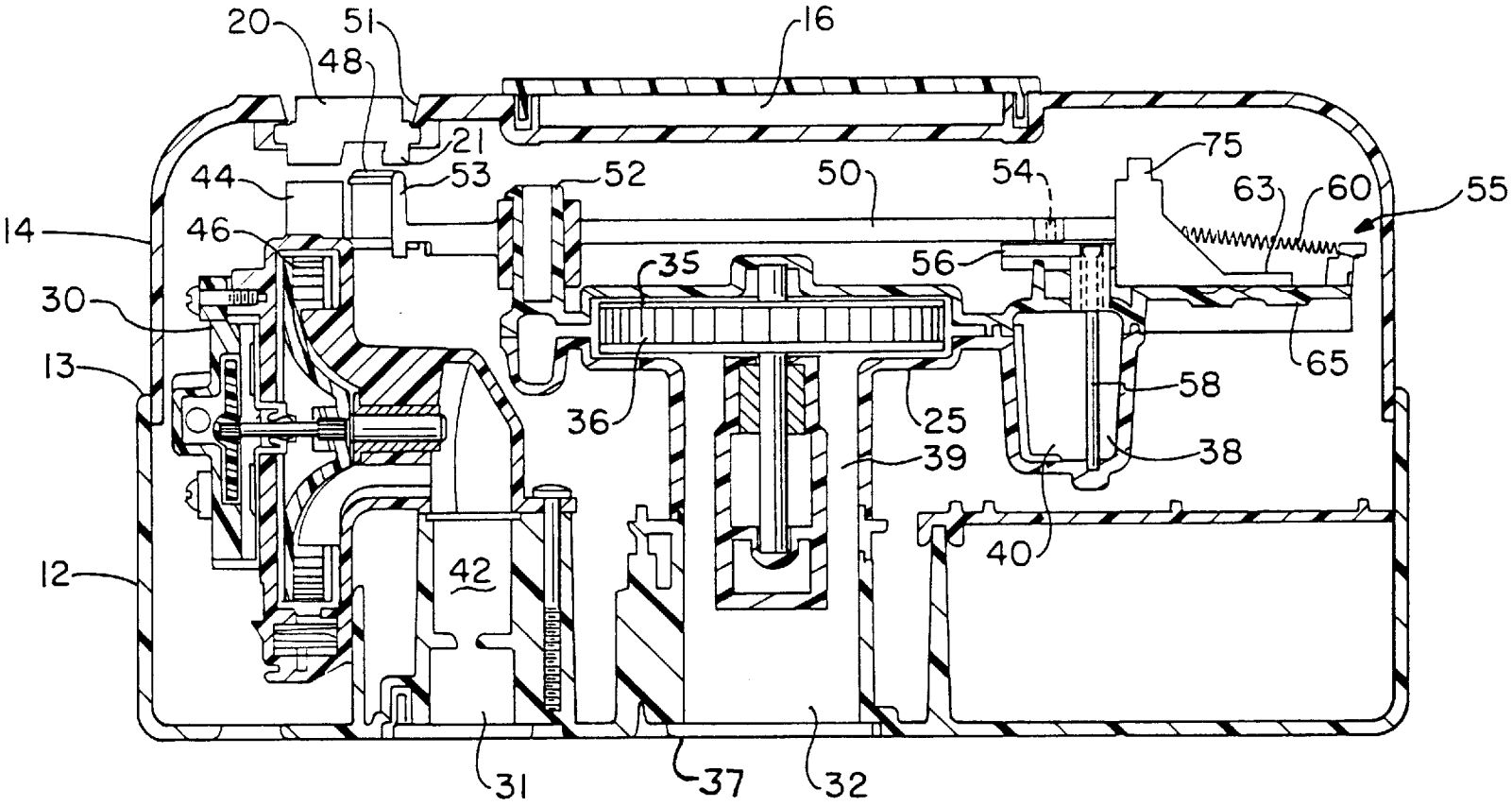
FIG. 4 is a cross-sectional view taken along line 4—4 in FIG. 2.
Figure 5:
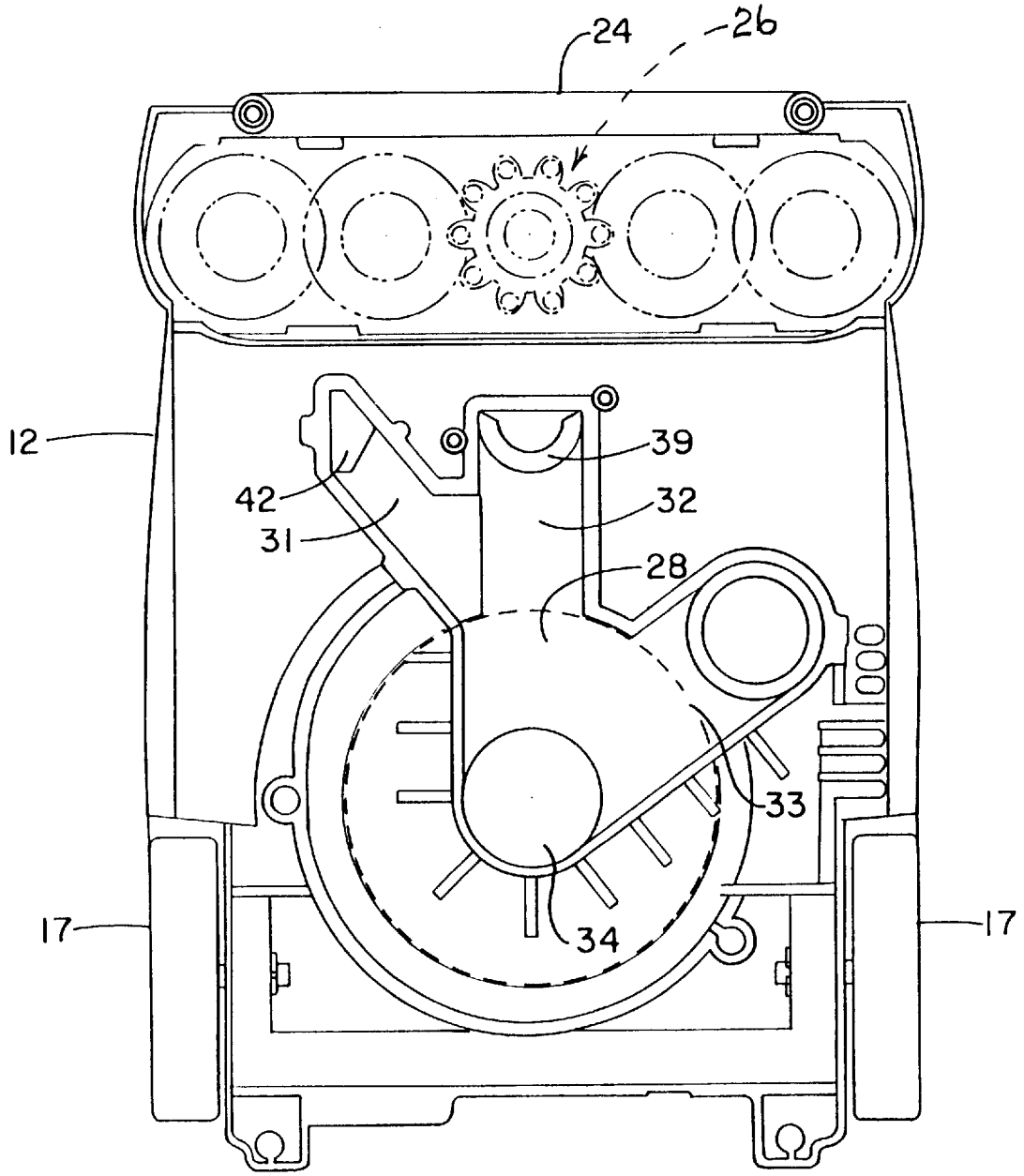
FIG. 5 is a bottom view of the carpet extractor illustrated in FIG. 1.
Figure 6:
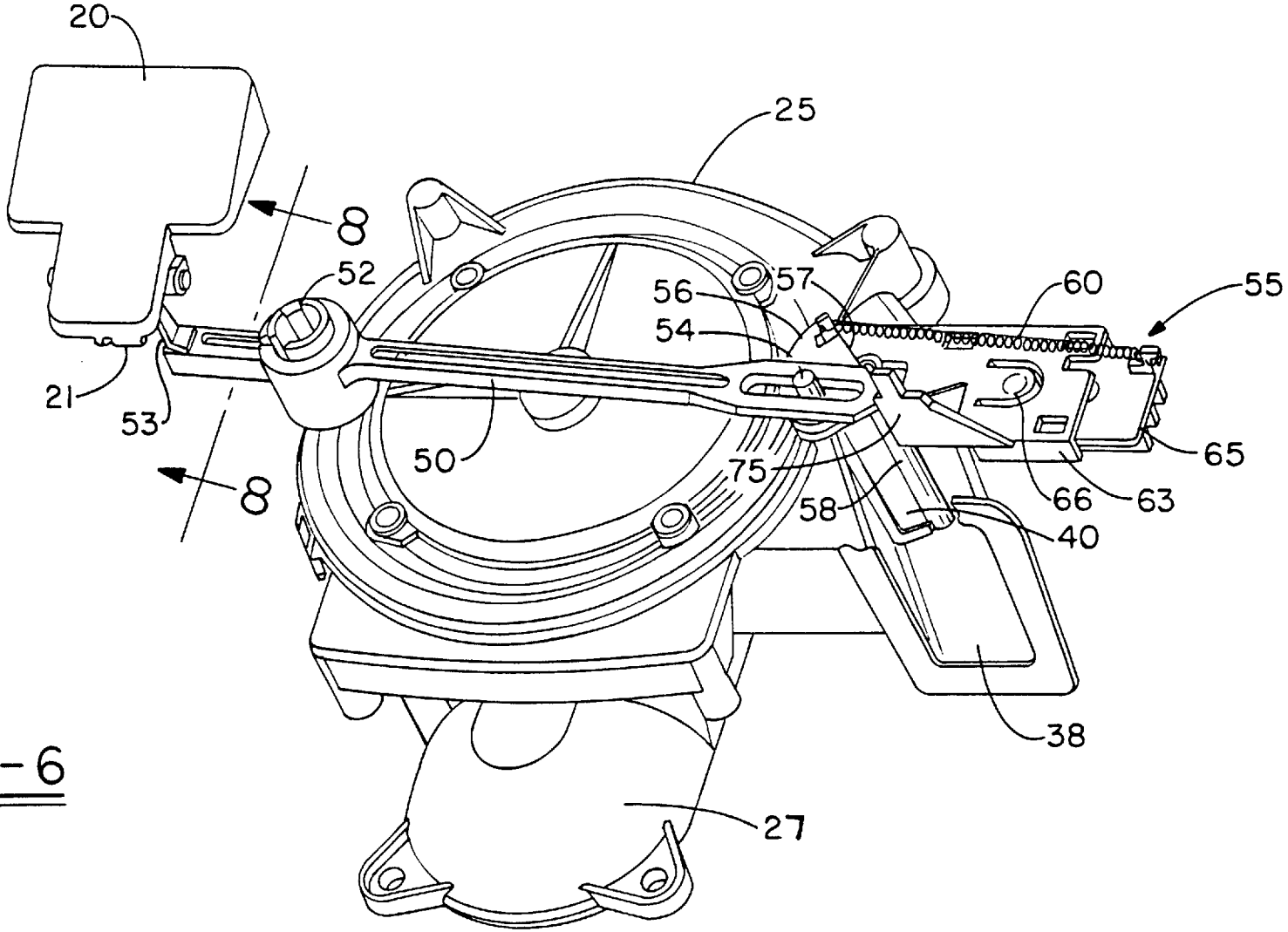
FIG. 6 is a pictorial view of the brush power turbine showing the turbine inlet throttle valve linkage.

Integrally molded into the underside of lower housing 12 (see FIG. 5) is a vacuum manifold 28 having extensions 31, 32, and 33 for providing a vacuum source for turbines 25 and 30. Manifold 28 is completed by a one piece bottom plate 37. Motor fan 22 generally provides suction to manifold 28 through the fan inlet or eye 34. As seen in FIG. 4 atmospheric air, driving the brush turbine rotor 36, enters plenum 35, surrounding rotor 36, by way of turbine inlet 38, passes through rotor 36 and into plenum 28 via exit conduit 39 and plenum extension 32. Positioned within inlet 38 is a throttle valve door 40 for energizing or de-energizing rotor 36.

Figure 11:
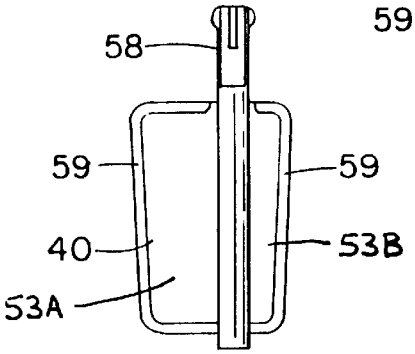
FIG. 11 is an elevational view of the brush drive air turbine throttle valve removed from the air turbine assembly.
Figure 12:
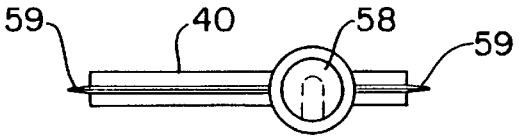
FIG. 12 is a top view of the throttle valve shown in FIG. 11.
Figure 13:
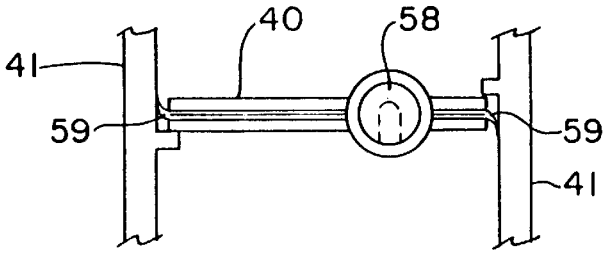
FIG. 13 is a schematic illustration of the throttle valve lip seal engaging the throttle inlet walls.

FIGS. 11 through 12 illustrate the preferred embodiment of throttle valve door 40 wherein the periphery of the door has extending therefrom a flexible lip seal 59. Lip seal 59 may be integrally molded with the door structure as an intentional "flash" of material around the door periphery having a controlled thickness such that it is flexible with respect to the door main body structure. As illustrated in FIG. 13, upon closing valve door 40, lip seal 59 sealingly engages the inside walls 41 of the turbine inlet 38.

Similar to air turbine 25, suction is supplied to exit conduit 42 of the air turbine driven fluid supply pump 30 thereby drawing atmospheric air into inlet 44, and through rotor 46 thereby energizing the air driven fluid pump 30.

Figure 2:
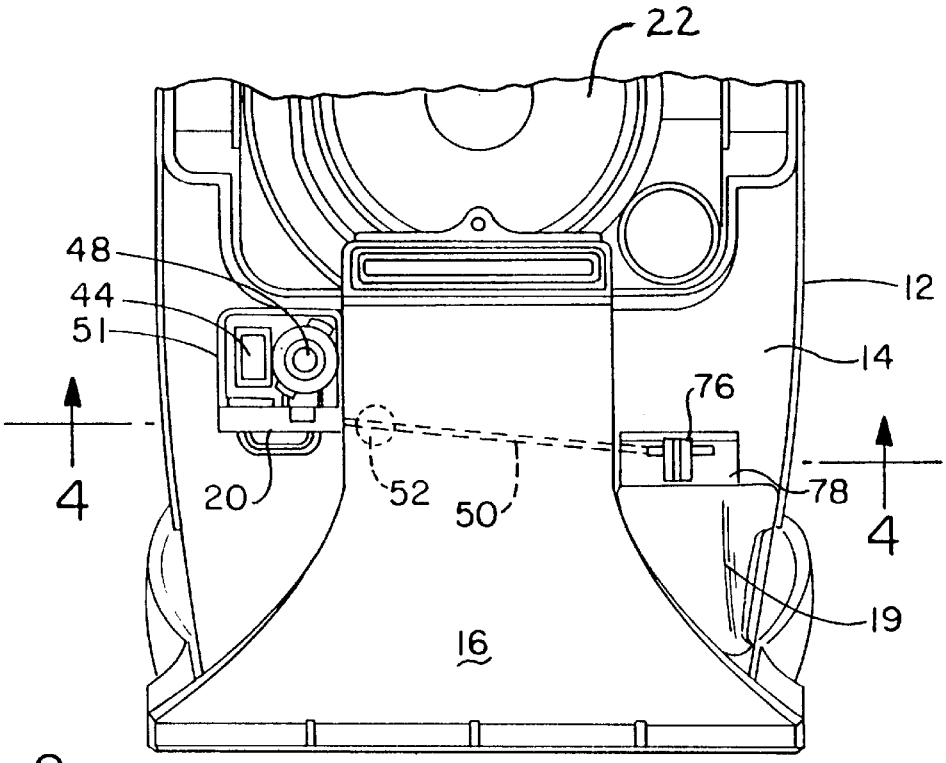
FIG. 2 is a plan view of the forward portion of the extractor base module illustrated in FIG. 1.
Figure 3:
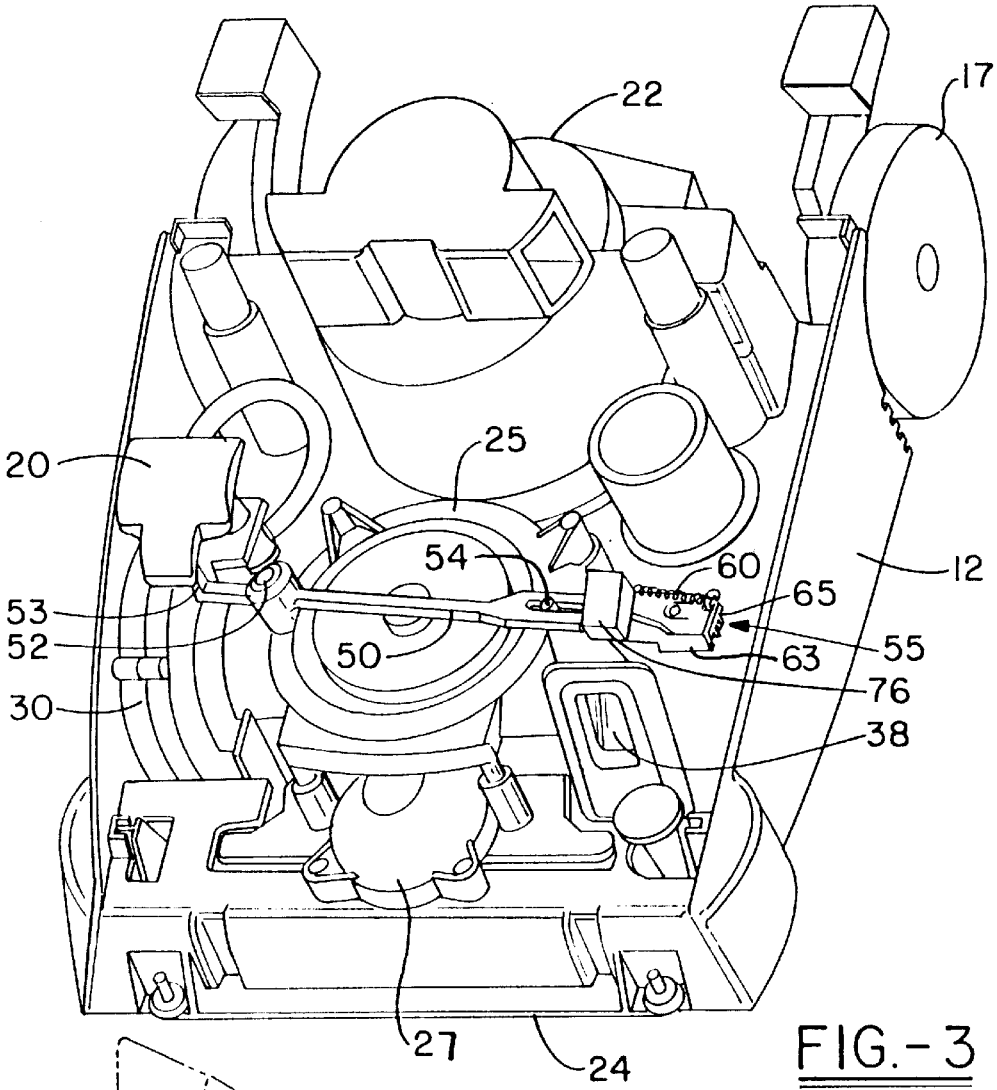
FIG. 3 illustrates the base module, illustrated in FIG. 1, having the top cover portion removed showing the general location of the air turbines and valve operating linkage.

Similar to the teaching of referenced co-owned U.S. Pat. No. 5,406,673, and as illustrated in FIGS. 1, 2, and 4, air turbine driven fluid pump 30 is positioned beneath upper housing 14 such that the turbine air inlet 44 and the adjacent fluid discharge nipple 48 are aligned with opening 51 in upper housing 14. A trap door valve 20 is hingedly attached to upper housing 14 such that when trap door 20 is closed, as seen in FIG. 1, turbine air inlet 44 is closed, thereby interrupting the air flow to rotor 46 and de-energizing turbine driven fluid pump 30. When door 20 is open, as illustrated in FIG. 2, air inlet 44 is open and atmospheric air is drawn through rotor 46 thereby energizing fluid pump 30. Also, similar to the teaching of co-owned U.S. Pat. No. 5,406,673, fluid discharge nipple 48 is accessible for attachment of a fluid supply line, not shown, extending to a hand held extractor nozzle for above floor cleaning of upholstery or the like.

Figure 14:
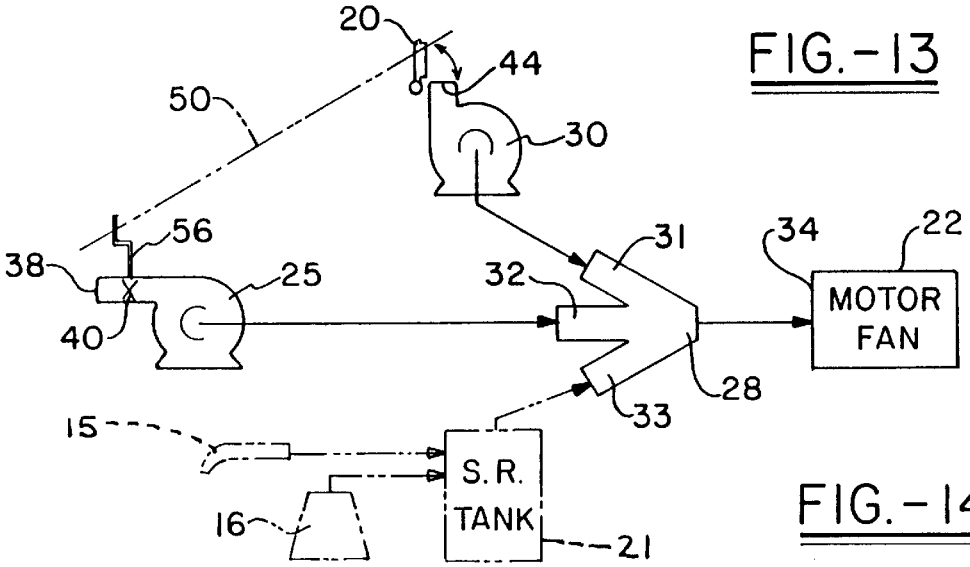
FIG. 14 is a schematic diagram illustrating the turbine air flow.

FIG. 14 provides a simplified schematic flow diagram illustrating the air flow paths, described above. Referring now to FIG. 14, vacuum is applied to manifold 28 by motor fan 22. When in the floor cleaning mode, trap door valve 20 is closed thereby de-energizing turbine driven fluid supply pump 30. However, throttle valve 40 is opened thereby energizing brush drive turbine 25. When in the above floor cleaning mode, throttle valve 40 is closed (thereby de-energizing brush drive turbine 25) and trap door valve 20 is opened energizing turbine driven fluid supply pump 30. Debris entrained air from the floor suction nozzle 16 or from the above floor cleaning apparatus 15 is directed to solution recovery tank 21. A suitable solution recovery tank and means for converting from the floor suction nozzle to above floor cleaning apparatus is taught in co-owned U.S. Pat. No. 5,406,673. Vacuum is supplied to the solution recovery tank from vacuum manifold 28 via manifold extension arm 33. Suitable means for supplying vacuum to the solution recovery tank is also taught in the above referenced co-owned U.S. Patent. Except for link 50, the elements in FIG. 14 illustrated with broken lines are taught in above referenced U.S. Pat. No. 5,406,673 which the preferred solution recovery tank system and means for converting from the floor cleaning mode to above floor cleaning mode.

In the interest of energy management, it is desirable that only one air turbine be energized at a time dependent upon the operational mode selected by the operator. When in the floor cleaning mode, only the brush drive turbine 25 is required to operate and when in the above floor mode only the turbine driven fluid pump 30 is required to operate. Therefore, a mechanical linkage system is provided whereby throttle valve 40 is caused to close when in the above floor cleaning mode, thereby de-energizing brush drive turbine 25.

Figure 8:
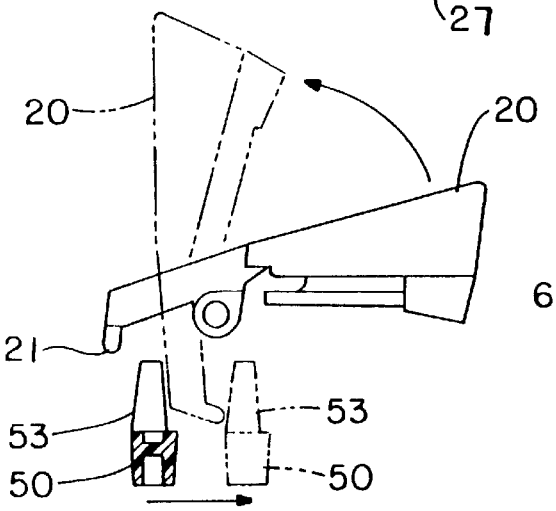
FIG. 8 is a view taken along line 8—8 in FIG. 6 illustrating the operation of the trap door valve associated with the air turbine driven solution supply pump.
Figure 9:
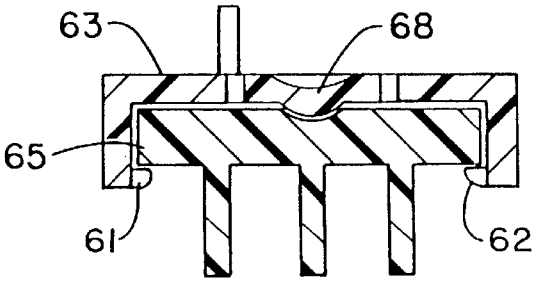
FIG. 9 is a cross-section taken along line 9—9 in FIG. 7.
Figure 7:
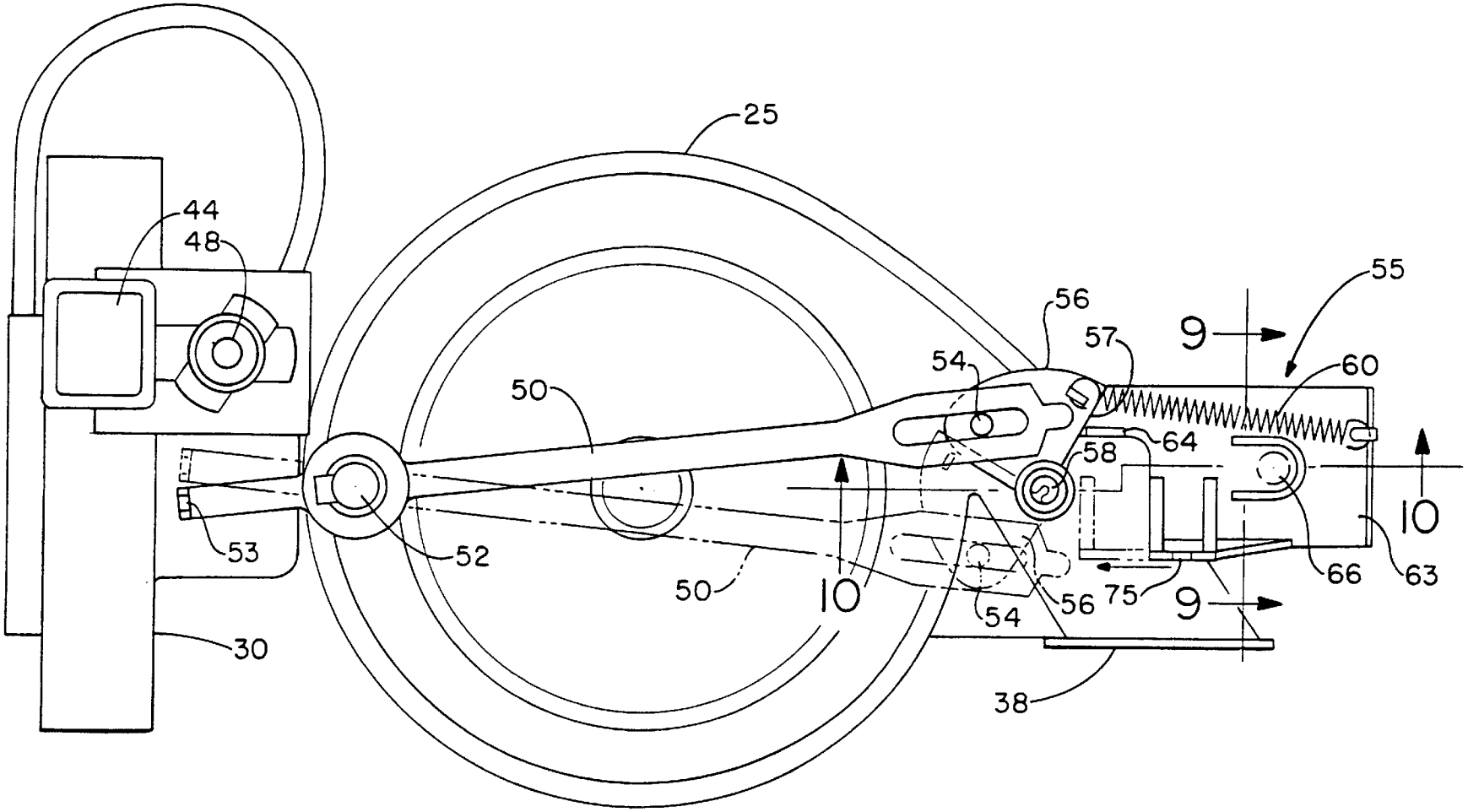
FIG. 7 is a plan view of the brush power turbine throttle valve linkage illustrating the operation thereof.
Figure 10:
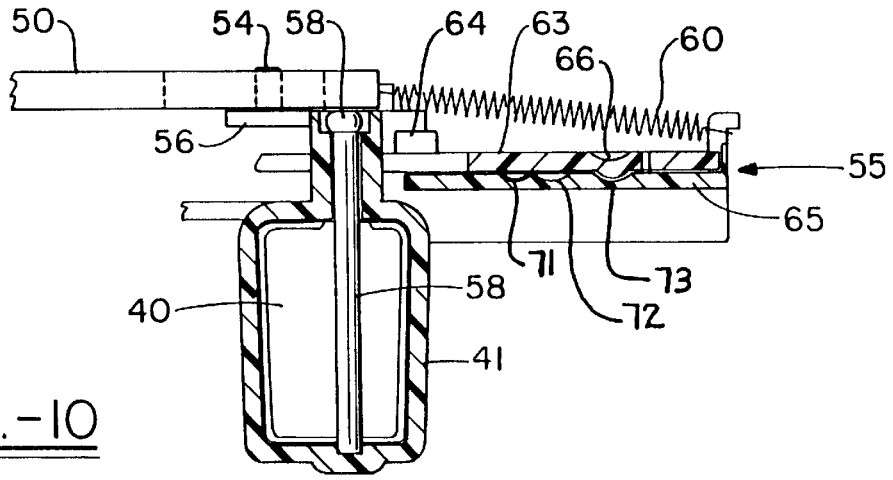
FIG. 10 is a cross-sectional view taken along line 10—10 in FIG. 7.

Referring to FIGS. 3 and 6 through 8, link 50, pivotally attached to pivot post 52, is caused to rotate clockwise about pivot 52, as illustrated in FIG. 7, when trap door valve 20 is placed in the open position, by engagement of tang 53, on door 20, and tang 53 on link 50 as illustrated in FIG. 8. At the opposite end thereof, link 50 is provided with a slot which slidingly receives therein pin 54 projecting upward from bell crank 56 attached to rotatable shaft 58 of throttle valve 40 such that rotation of bell crank 56 likewise rotates shaft 58 thereby opening or closing throttle valve 40. Thus, as illustrated in the figures, opening of trap door 20 (when converting to above floor mode) link 50 rotates clockwise about post 52 thereby rotating bell crank 56 counterclockwise causing throttle valve 40 to close interrupting the air supply to and de-energizing brush turbine 25 while at the same time liquid supply pump 30 is energized by the opening of trap door valve 20. When trap door valve 20 is closed, thereby de-energizing air turbine pump 30, spring 60 returns bell crank 56 to its original, at rest position, thereby opening throttle valve 40 and energizing brush drive turbine 25.

It is preferable, as illustrated in FIGS. 11 through 14, that throttle valve 40 be non-symmetrical about shaft 58 having a larger area 53A on one side thereof. Thus the centroid of area 53A has a greater moment arm (about the vertical axis) than the smaller area 53B. Thus air flowing through throttle valve 40 to turbine 25 creates a clockwise moment thereon maintaining the valve in the open position and prevents valve flutter.

Referring now to FIGS. 6, 7, 9, and 10, a manual override mechanism 55 is provided whereby the operator, operating in the floor cleaning mode, may selectively close throttle valve 40 thereby de-energizing brush drive turbine 25 or select an intermediate position whereby throttle valve 40 is partially closed thereby reducing the air flow through throttle valve 40 causing brush drive turbine 25 to rotate at a slower speed resulting in slower rotating brushes.

Override mechanism 55 comprises a table 65 integrally molded to the body of brush drive turbine 25 having slide 63 slidingly attached thereto by means of tabs 61 and 62. Projecting upward from slide 63 is post 64. As slide 63 is moved left by the operator, as viewed in FIG. 6, post 64 engages the flank side 57 of bell crank 56 rotating bell crank 56 and throttle valve 40 counterclockwise thereby closing throttle valve 40 and de-energizing brush drive turbine 25. Upon return of slide 63 to its original position (as illustrated in FIG. 7), spring 60 causes bell crank 56 to rotate clockwise, thereby rotating throttle valve 40 to the full open position.

Generally positioned along the lateral center line of slide 63 is a cantilevered tab 66 having a bulbous boss 68 that releasingly engages concavities 71, 72, and/or 73 in the surface of table 54. Concavity 71 corresponds to the full closed position of throttle valve 40, concavity 73 corresponds to the full open position of valve 40, and concavity 72 corresponds to an intermediate, partially open, position of valve 40. Thus when operating in the floor cleaning mode, the operator may select the maximum turbine/brush speed, an intermediate turbine/brush speed or stop the turbine (and brushes) completely. Additional intermediate positions may be added, if desired, by adding additional concavities.

Extending upward from slide 63 is lever arm 75 having a conveniently shaped finger cap 76 atop thereof. Lever arm 75 extends upward through a suitable opening (not shown) in upper housing 14 whereby cap 76 is received within recess 78 in upper housing 14.

The invention has been described with reference to the preferred embodiment. However, obvious modifications and alterations will occur to others upon reading and understanding of the specification. It is our intention to include all such modifications, alterations and equivalents in so far as they come within the scope of the appended claims or the equivalents thereof.

We claim:

1. In a floor scrubbing extractor having a motor/fan assembly for creating an air flow, a power driven brush system for scrubbing the floor to be cleaned, and means for converting the extractor from a floor scrubbing mode to an above floor upholstery cleaning mode, the improvement comprising:

a first selectively energized air driven turbine for driving said brush system when the extractor is operated in the floor scrubbing mode; and a second selectively energized air driven turbine for supplying pressurized cleaning solution to an above floor upholstery cleaning conversion means.

2. An extractor according to claim 1, wherein said first and second turbines are mutually exclusively energizable.

3. An extractor according to claim 2, said improvement further comprising:

first and second valves;

said first valve disposed in the air flow for said first turbine;

said second valve disposed in the working air flow for said second turbine; and a mechanical link system operably connected to each of said valves;

said mechanical link system operable to close said first valve when said second valve is opened.

4. An extractor according to claim 3, wherein said mechanical link system comprises a link having a first end and a second end; said first end of said link being operably connected to said first valve; said second end of said link being positioned to engage said second valve when said second valve is moved from a closed position to an open position.

5. An extractor according to claim 4, wherein said mechanical link system further comprises:

a bell crank connected to said first valve such that rotation of said bell crank rotates said first valve between open and closed positions;

a spring connected to said bell crank biasing said bell crank and said first valve toward the open position; and a pin extending from said bell crank;

said first end of said link having a slot therein;

said pin being slidingly received in said slot.

6. An extractor according to claim 5, wherein said mechanical link system further comprises a manual override mechanism operably connected to said first valve, said manual override mechanism movable between two positions.

7. An extractor according to claim 6, wherein said manual override mechanism comprises:

a table extending from said first turbine;

a slide slidingly engaging said table between said two positions; and a cantilevered tab carried by said slide;

said cantilevered tab engaging said table;

said table having at least two concavities configured to accept said cantilevered tab;

said slide engaging said bell crank at one of said positions and thereby closing said first valve;

said spring connected to said slide.

8. A carpet extractor, comprising:

a base;

a motor/fan assembly carried by said base operable to create an air flow;

a powered brush system carried by said base having at least one brush disposed to contact said surface to the cleaned;

conversion means for converting the extractor from a surface cleaning mode to an above-surface cleaning mode;

said conversion means at least partially comprising a fluid pump;

a first air turbine in selective fluid communication with said air flow for selectively powering said powered brush systems; and a second air turbine in selective fluid communication with said air flow for selectively powering said fluid pump.

9. A carpet extractor according to claim 8, wherein said turbines are mutually exclusively operable.

10. A carpet extractor according to claim 9, further comprising a mechanical link system in communication with said first and second turbines; said mechanical link system de-energizing said first turbine when said second turbine is energized.

11. A carpet extractor according to claim 10, further comprising a manual override system; said manual override system operable to de-energize said first turbine while said second turbine is de-energized.

12. A carpet extractor according to claim 11, wherein said manual override mechanism further comprises:

a post attached to said slide;

said post engaging said bell crank when said slide is moved toward said first position thereby closing said first valve.

13. A carpet extractor according to claim 10, further comprising:

a first valve disposed in said air flow for said first turbine;

a second valve disposed in said air flow for said second turbine;

said mechanical linkage system comprising:

a pivotally mounted link having first and second ends;

a bell crank attached to said first valve and said first end of said first link;

said second end of said link disposed adjacent to said second valve such that said second valve engages said second end of said link when said second valve is open; and a spring biasing said bell crank and said first valve toward an open position for said first valve.

14. A carpet extractor according to claim 13, further comprising a manual override system; said manual override system comprising:

a table;

a slide slidably carried by said table;

said slide movable between first and second positions;

said spring extending between said slide and said bell crank; and a cantilevered tab connected to said slide and engaging said table.

15. A carpet extractor according to claim 14, wherein said table has a plurality of concavities, said cantilevered tab engaging each of said concavities as said slide is moved from said first position to said second position.

16. A carpet extractor according to claim 15, further comprising a bulbous boss attached to an end of said cantilevered tab, said boss being received in said concavities.

17. A carpet extractor comprising:

a cleaning liquid reservoir for providing a supply of cleaning liquid;

a cleaning liquid distributor in selective fluid communication with said cleaning liquid reservoir for selectively distributing the cleaning liquid onto a floor surface;

a powered brush system having at least one brush for scrubbing the distributed cleaning solution on the floor surface;

a motor/fan assembly;

a floor nozzle in selective fluid communication with said motor/fan assembly for extracting the distributed and scrubbed cleaning solution from the floor surface;

a liquid pump in fluid communication with said cleaning liquid reservoir for providing a source of pressurized cleaning liquid;

an above-floor cleaning tool having a cleaning liquid applicator in selective fluid communication with said liquid pump for selectively applying cleaning liquid to an above-floor surface and an above-floor nozzle in selective fluid communication with said motor/fan assembly for extracting the applied cleaning liquid from the above-floor surface; and a conversion mechanism operatively connected to said powered brush system and operatively connected to said liquid pump for selectively activating said powered brush system and de-activating said liquid pump placing said extractor in a floor cleaning mode; and activating said liquid pump and de-activating said powered brush system placing said extractor in an above-floor cleaning mode, wherein at least one of said powered brush system and said liquid pump is driven by an air powered turbine that is in fluid communication with said motor/fan assembly whereby said motor/fan assembly creates a flow of air through said turbine for driving said turbine.

18. A carpet extractor according to claim 17, wherein said conversion mechanism comprises an actuator that is selectively, manually actuated between a floor mode position and an above-floor mode position, said actuator being operatively connected to said liquid pump for activating said pump when in said above-floor mode position and de-activating said pump when in said floor mode position.

19. A carpet extractor according to claim 18, wherein said turbine is operatively connected to said liquid pump for driving said pump.

20. A carpet extractor according to claim 19, wherein said conversion mechanism includes a first valve positioned in the flow of air through said turbine and operatively connected to the actuator, whereby said actuator closes said valve blocking the flow of air through said turbine when in said floor mode position and opens said valve allowing air to flow through said turbine when in said above-floor mode position.

21. A carpet extractor according to claim 18, said turbine is a first turbine operatively connected to said brush system for driving said at least one brush.

22. A carpet extractor according to claim 21, wherein said conversion mechanism includes a first valve positioned in the flow of air through said first turbine and operatively connected to said actuator, whereby said actuator opens said first valve when in said floor mode position and closes said first valve when in said above-floor mode position.

23. A carpet extractor according to claim 21, wherein a second turbine is operatively connected to said liquid pump for driving said pump.

24. A carpet extractor according to claim 23, wherein said conversion mechanism includes a second valve positioned in the flow of air through said second turbine and operatively connected to the actuator, whereby said actuator closes said second valve blocking the flow of air through said turbine when in said floor mode position and opens said second valve allowing air to flow through said turbine when in said above-floor mode position.

25. A carpet extractor according to claim 24, wherein said second valve comprises a trap door that selectively opens and closes one of an inlet or outlet opening of said second turbine.

26. A carpet extractor according to claim 25, wherein said trap door has a tab, whereby the operator may open said trap door, and a finger extending from said tab that engages a second end of said link, whereby said trap door is said actuator.

27. A carpet extractor according to claim 23, wherein said conversion mechanism further comprises a mechanical link having a first end operatively connected to said first valve and a second end positioned to be engaged by said actuator when said actuator is actuated to said above-floor mode position, whereby when said actuator is moved to said above-floor mode position said link system is actuated by said actuator and de-actives said brush system.

28. A carpet extractor according to claim 27, further comprising at least one spring for biasing said actuator and said link into said floor mode position.

29. A carpet extractor according to claim 28, wherein said mechanical link system further comprises:

a bell crank connected to said first valve such that rotation of said bell crank rotates said first valve between open and closed positions;

a spring connected to said bell crank for biasing said bell crank and said second valve toward said open position;

a pin extending from said bell crank; and wherein said mechanical link has a first end with a slot therein with said pin being slidingly received in said slot.

30. A carpet extractor according to claim 29, further comprising a manual override mechanism that, when actuated, engages said first valve to close said first valve when the carpet extractor is in the floor mode position.

31. A carpet extractor according to claim 30, wherein said override mechanism comprises:

a table mounted to said extractor;

a slide slidingly engaging said table;

an actuation knob extending from said slide for actuation by an operator of the extractor; and wherein said slide engages said bell crank when actuated by an operator and thereby closes said first valve.

32. A carpet extractor according to claim 31, wherein said manual override mechanism further comprises:

a cantilevered tab carried by said slide;

at least two concavities in said table configured to accept said cantilevered tab for retaining said slide in at least two positions; and said slide engaging said bell crank at one of said two positions and thereby closing said first valve, and said slide being disengaged from said bell crank at the other of said two positions.

* * * * *